US008251211B1

(12) United States Patent
Chen et al.

(10) Patent No.: US 8,251,211 B1
(45) Date of Patent: Aug. 28, 2012

(54) TOOL STORAGE BOX

(76) Inventors: Yi-Ying Chen, Tai Ping (TW); Shu-Fen Cheng, Tai Ping (TW)

( * ) Notice: Subject to any disclaimer, the term of this patent is extended or adjusted under 35 U.S.C. 154(b) by 0 days.

(21) Appl. No.: 13/346,202

(22) Filed: Jan. 9, 2012

(51) Int. Cl.
*B65D 85/28* (2006.01)

(52) U.S. Cl. ..... 206/373; 206/375; 220/811

(58) Field of Classification Search ..... 206/372, 206/373, 374, 375, 376, 378, 379; 220/811, 220/345.1, 345.2, 345.3, 348
See application file for complete search history.

(56) References Cited

U.S. PATENT DOCUMENTS 7,810,415 B2 * 10/2010 Adamany et al. ..... 81/440
8,038,004 B2 * 10/2011 Hu ..... 206/375
2004/0065574 A1 * 4/2004 Hernandez et al. ..... 206/373

* cited by examiner

*Primary Examiner* — Jacob K Ackun

(57) ABSTRACT

A tool storage box with sliding and rotating functions includes a box body, a sliding base, and a tray for tool head portions. The box body has a space for the sliding base and the tray. The sliding base controls sliding of the tray in the space. The sliding base is provided with a pivotal shaft and a locking hook for controlling the sliding base. The pivotal hole has a pivotal trough. A peripheral surface of the pivotal trough has a positioning surface. The tray has a pivotal shaft and a positioning post for controlling rotation of the tray. The pivotal shaft engages with the pivotal hole of the sliding base to act as a center of rotation of the tray. When the tray slides out of the box body, the positioning post engages with the pivotal trough, and the tray is rotatable by means of an external force.

4 Claims, 6 Drawing Sheets

TOOL STORAGE BOX

BACKGROUND OF THE INVENTION

1. Field of the Invention

The present invention relates to a tool storage box, and in particular to a tool storage box with sliding and rotating functions.

2. Description of Prior Art

With the rapid development of science and technology, hand tools are widely used by workers, personnel and the masses. Various electronic devices, furniture, toys used in our daily life are each provided with screws for fixing respective components into one body. Thus, screw driver has become a necessity in our life. Since various kinds of screw drivers have different tool head portions, a user often buys a set of screw drivers in order to fit various kinds of screws. If the user does not also buy a tool storage box for accommodating these different screw drivers and associated fittings, some of the screw drivers and the fittings may get lost after using for a period of time. On the other hand, with the increased kinds of tools, the number and kind of the associated fittings also increase accordingly. Currently, a hand tool having a changeable tool head portion is proposed. Various kinds of tool head portions and a connecting rod are disposed in a tool storage box. By this arrangement, the user can select a desired kind of tool head portion and assemble the selected tool head portion with the connecting rod to form a desired hand took. In this way, the money for buying a lot of hand tools is saved and the total volume occupied by these hand tools is reduced for better storage. Therefore, the industry in this field aims to develop a tool storage box with better functions and convenience.

However, there is still room for improvement in existing tool storage boxes. For example, the tool storage box is provided with a cover portion, and a fastener is provided on the cover portion for fastening the cover portion to the tool storage box, thereby closing the tool storage box. Thus, the user needs to use his/her both hands to lock/release the fastener to thereby close/open the cover portion. Since the cover portion has a certain volume, even the fastener is released, the user still needs to rotate the cover portion to open the cover portion completely because there is no cover-rotating means. As a result, the user has to press the fastener and open the cover portion by two hands, otherwise the cover portion cannot be rotated and opened completely. Even though the cover-rotating means may make the cover portion to be opened easily, the hand tools and fittings in the tool storage box may spread outside the tool storage box if the user rotates the cover portion carelessly. On the other hand, the accommodating space in the tool storage box is insufficient, so that it is uneasy for the user to take the tool head portions out of the tool storage box. Actually, the user has to rotate the tool head portions to an angle so as to get the desired tool head portion.

In order to solve the above problems, the present inventor proposes a tool storage box with sliding and rotating functions based on his expert experience and delicate researches.

SUMMARY OF THE INVENTION

In order to solve the above problems, an objective of the present invention is to provide a tool storage box with sliding and rotating functions, which can be opened to take out the tool head portions easily.

In order to achieve the above objective, the present invention provides a tool storage box with sliding and rotating functions, which includes a box body, a sliding base, an accommodating tray, and a plurality of tool head portions. The interior of the box body is provided with an accommodating space for allowing the sliding base and the accommodating tray. A button is provided on the box body. An abutting rib is provided on the button. The sliding base is provided with at least one locking rib to at a position corresponding to the abutting rib. The abutting rib on the button acts with the locking rib on the sliding base to activate the sliding of the sliding base, thereby pushing the accommodating tray outwardly. Both ends inside the box body are provided with a locking trough respectively. When the sliding base and the accommodating tray slide open relative to each other, the locking trough and a locking hook on the sliding base are engaged with each other, thereby preventing the accommodating tray from sliding off the sliding base. The sliding base is provided with a pivotal hole for allowing a pivotal shaft of the accommodating tray to be positioned therein, thereby allowing the accommodating tray to slide open or close relative to the sliding base. The pivotal shaft of the accommodating tray is inserted into the pivotal hole of the sliding base. Then, by rotating the accommodating tray, a positioning post on the pivotal shaft can be positioned into a pivotal trough of the pivotal hole, thereby generating a rotation of 360 degrees or any suitable angle. In this way, the user can take out the tool head portions easily.

In order to better understand the objectives, structures and characteristics of the present invention, the technical contents, measures and effects of the present invention will be described in more detail with reference to a preferred embodiment shown in the accompanying drawings.

DETAILED DESCRIPTION OF THE INVENTION

Figure 1:
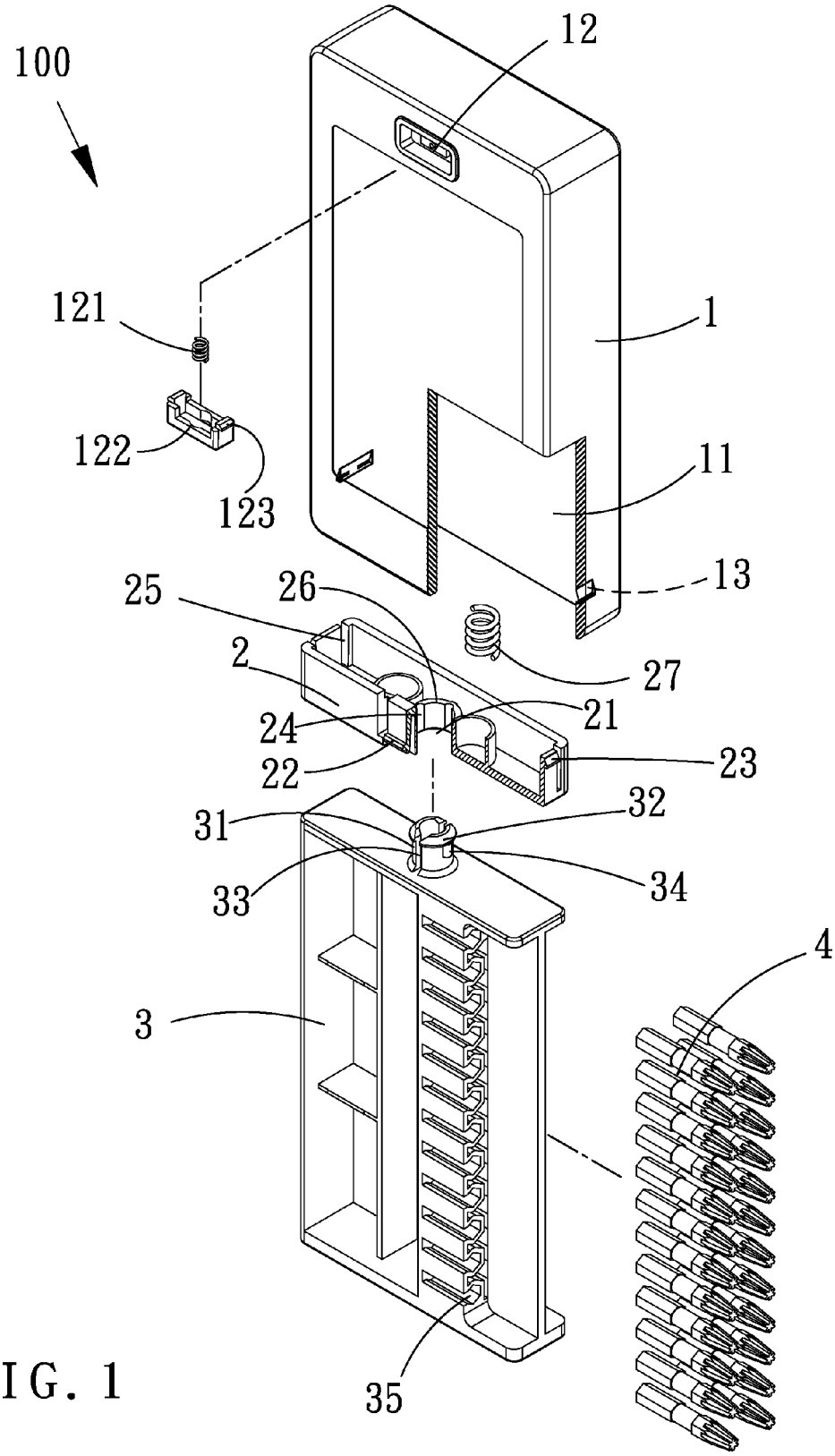
FIG. 1 is an exploded perspective view showing an embodiment of the present invention.

In order to make the Examiner to fully understand the characteristics and features of the present invention, a description relating thereto will be made with reference to the accompanying drawings.

Please refer to FIGS. 1 to 6. The present invention provides a tool storage box 100 with sliding and rotating functions, which includes a box body 1, a sliding base 2, an accommodating tray 3, and a plurality of tool head portions 4.

Figure 2:
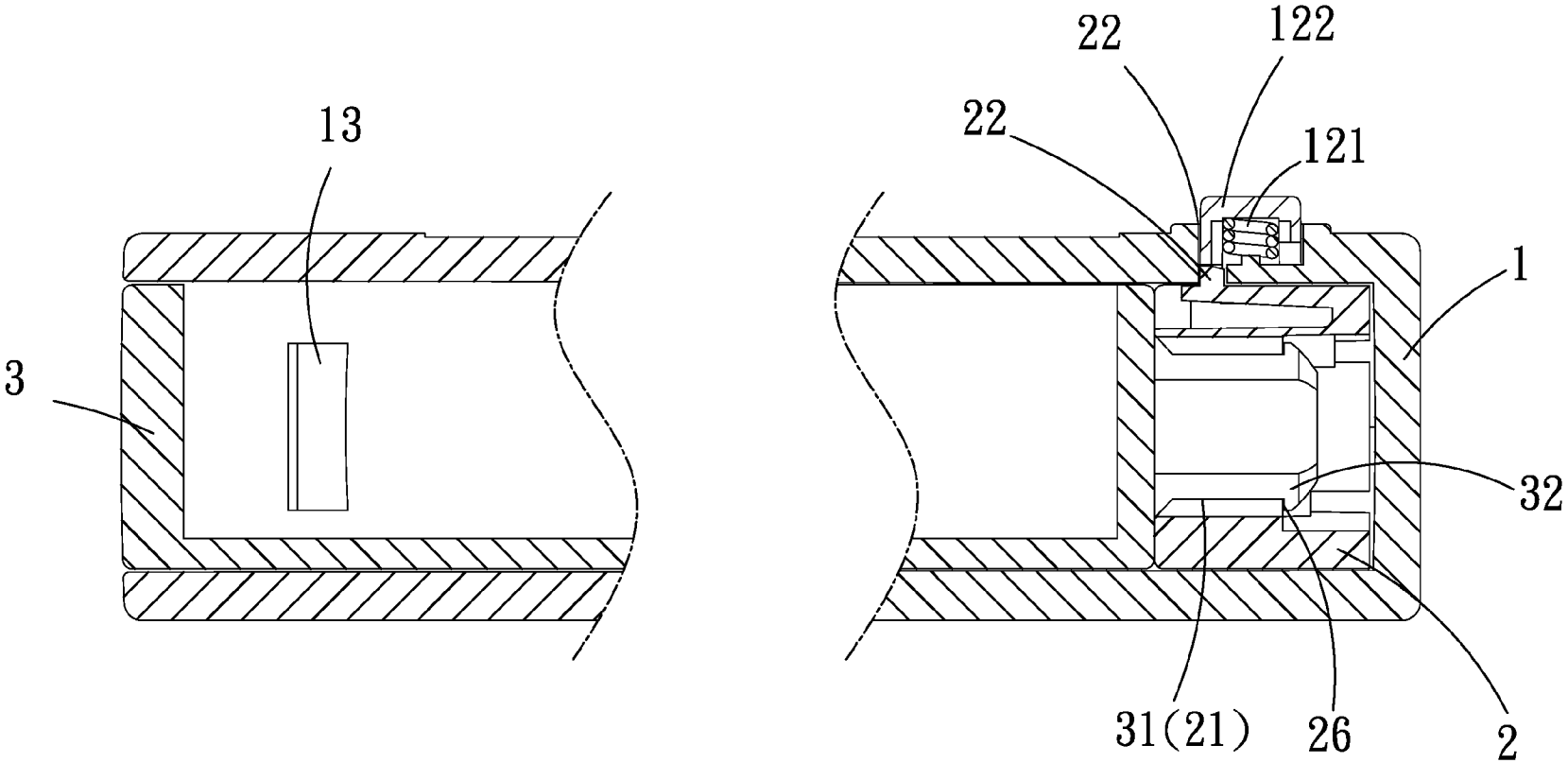
FIG. 2 is a cross-sectional view showing the embodiment of the present invention.
Figure 3:
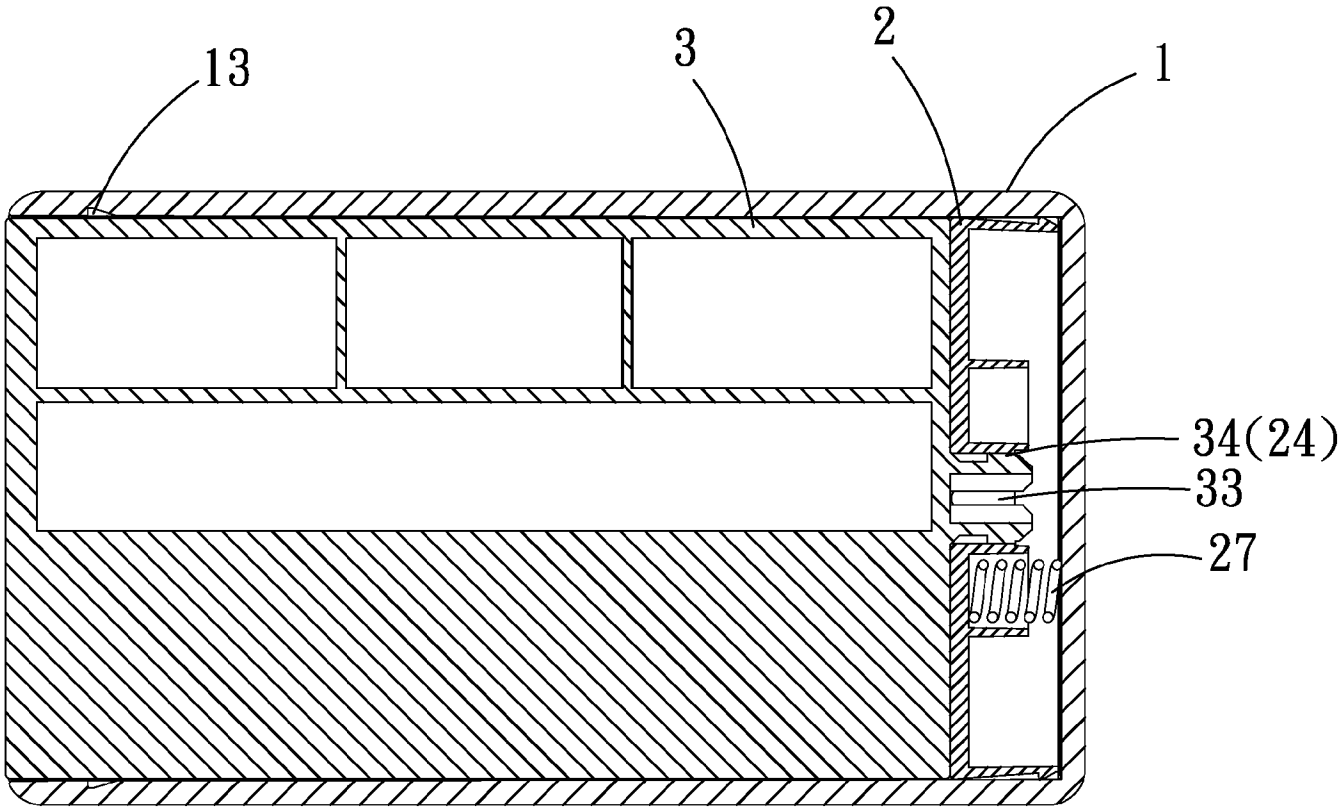
FIG. 3 is another cross-sectional view showing the embodiment of the present invention.

Please refer to FIGS. 1 to 3. The box body 1 is provided with at least one accommodating space 11, a button hole 12, and a locking trough 13. The sliding base 2 and the accommodating tray 3 are accommodated in the accommodating space 11. The button hole 12 is provided at an upper portion of the box body 1. An elastic element 121 is disposed between the button hole 12 and a button 122. When the button 122 is pressed, the elastic element 121 can activate the sliding base 2 to slide, thereby opening the sliding base 2 and the accommodating tray 3 simultaneously. Both ends inside the box body 1 are provided with a locking trough 13 respectively. When the sliding base 2 and the accommodating base 3 slide open, the locking trough 13 is engaged with a locking hook 23 on the sliding base 2, thereby preventing the accommodating tray 3 from sliding off the sliding base 2.

Please refer to FIGS. 1 to 3. The sliding base 2 comprises a pivotal hole 21, a locking rib 22, a locking hook 23, a pivotal trough 24, an insertion trough 25, a positioning surface 26, and an elastic element 27. The pivotal hole 21 of the sliding base 2 is engaged with the pivotal shaft 31 of the accommodating tray 3, and the positioning surface 26 abuts against an engaging piece 32 for positioning. The sliding base 2 is provided with the locking rib 22. The button 122 is provided with an abutting rib 123 at a position corresponding to the locking rib 22. The abutting rib 123 on the button 122 acts with the locking rib 22 on the sliding base 2 to activate the motion of the elastic element 27 of the sliding base 2, thereby pushing the accommodating tray 3 outwardly. In this way, the accommodating tray 3 can slidably open or close relative to the sliding base 2. Both sides of the sliding base 2 are provided with the locking hook 23 respectively. The locking hook 23 acts as an elastic body relative to the insertion trough 25. When the sliding base 2 slides downwardly to the locking trough 13 of the box body 1, the locking hook 23 slides to be engaged into the locking trough 13, thereby preventing the accommodating tray 3 from sliding off the sliding base 2.

Figure 4:
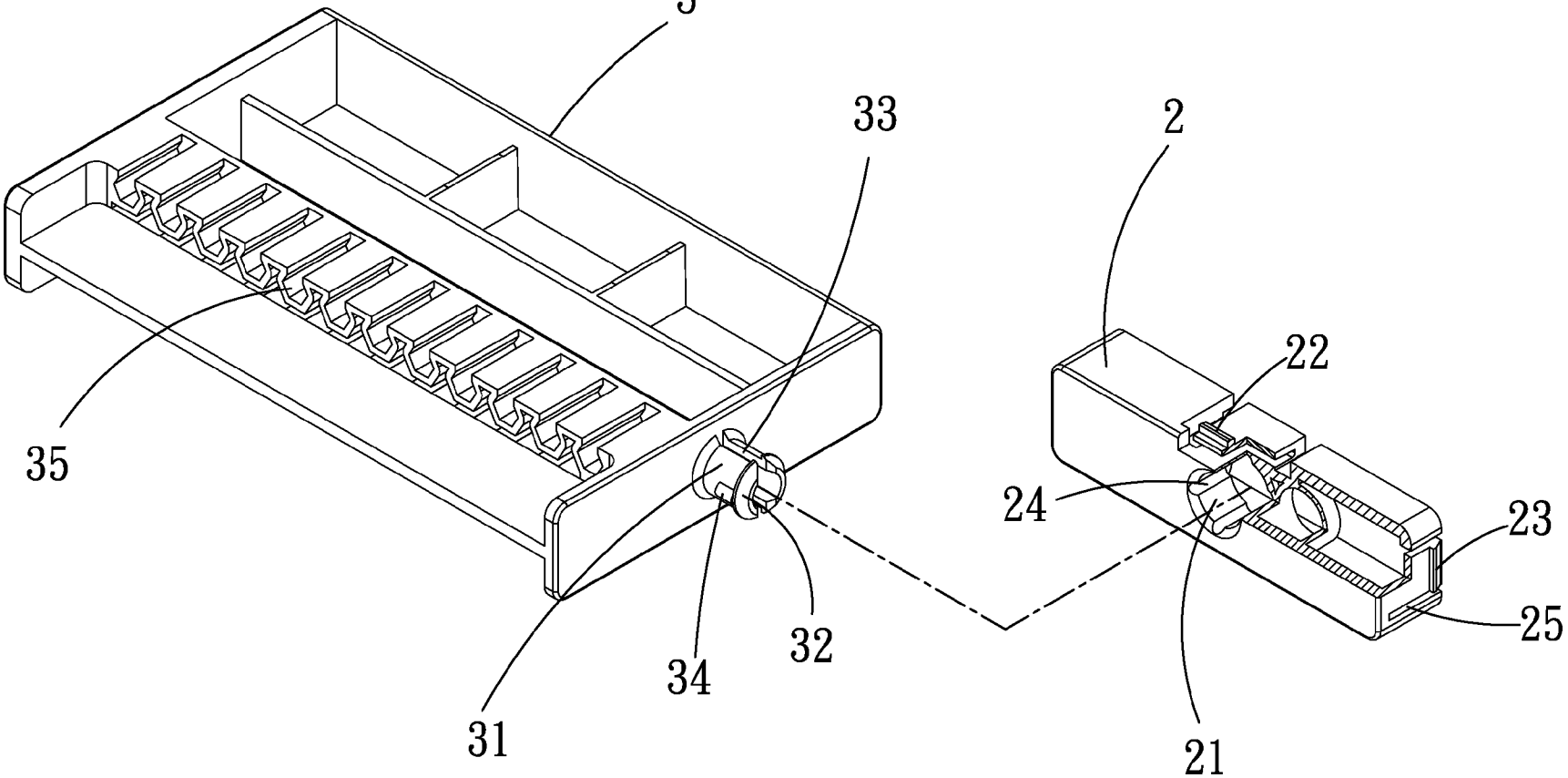
FIG. 4 is a schematic view showing the state before the sliding base is assembled with the accommodating tray of the present invention.
Figure 5:
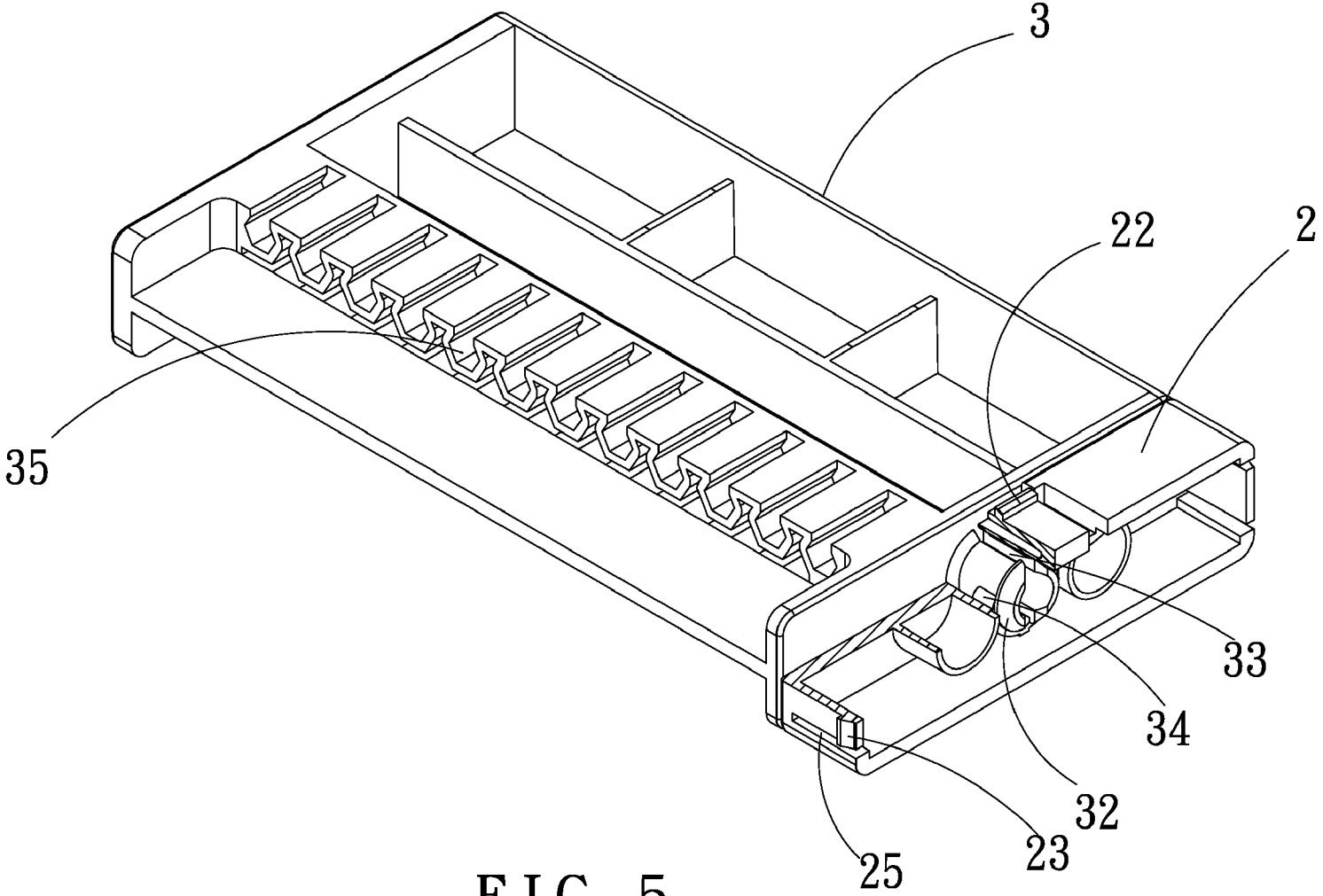
FIG. 5 is a schematic view showing the state after the sliding base is assembled with the accommodating tray of the present invention.
Figure 6:
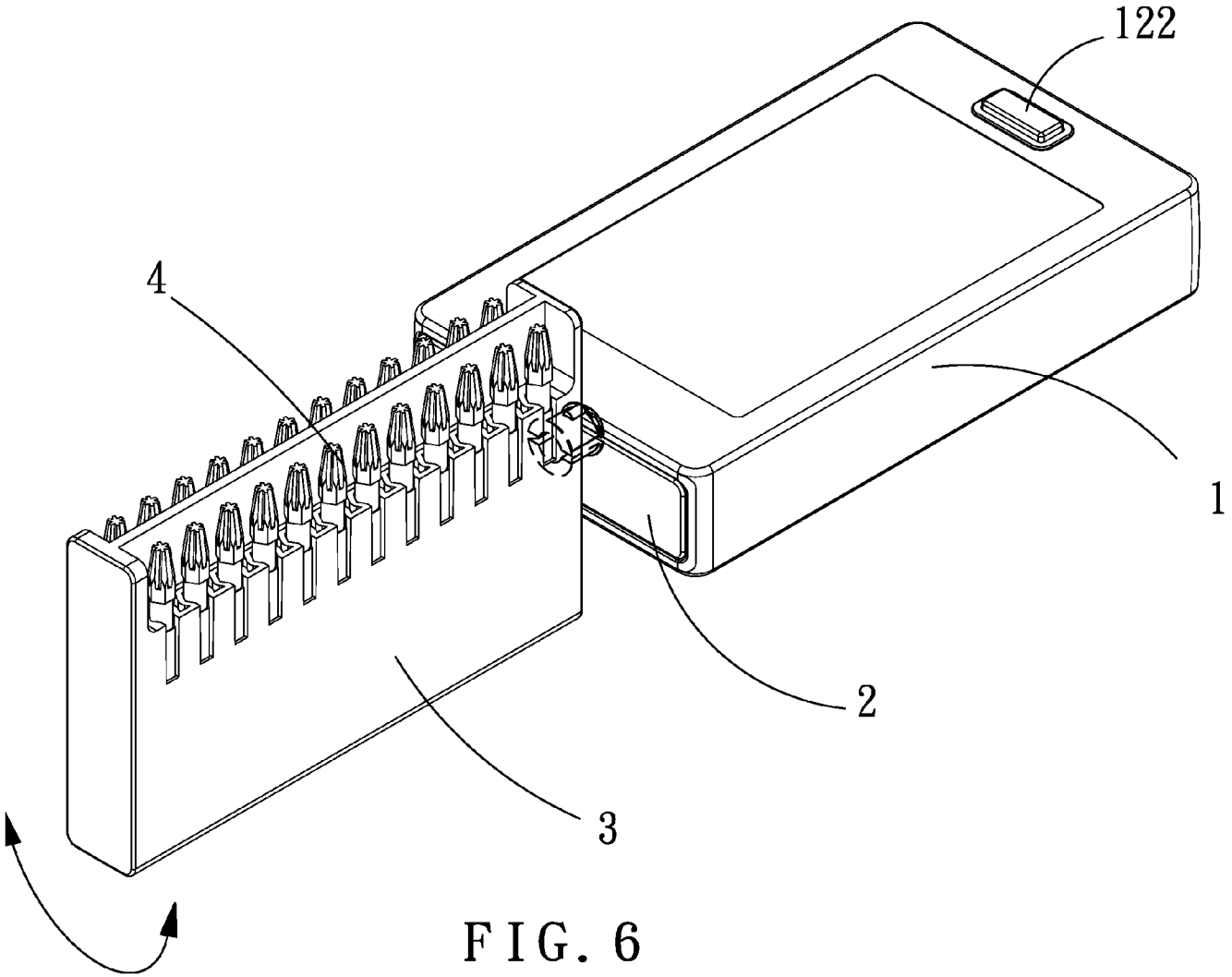
FIG. 6 is a schematic view showing a rotating action of the accommodating tray according to the embodiment of the present invention.

Please refer to FIGS. 4 to 6. The accommodating tray 3 comprises a pivotal shaft 31, an engaging piece 32, a groove 33, a positioning post 34, and a plurality of accommodating troughs 35. The pivotal shaft 31 on the accommodating tray 3 is engaged with the pivotal hole 21 of the sliding base 2. The engaging piece 32 abuts against the positioning surface 26 of the sliding base 2, thereby preventing the accommodating tray 3 from sliding off the sliding base 2. The accommodating tray 3 can rotate 360 degrees or any suitable angle relative to the sliding base 2 by using the pivotal shaft 31 as a center of rotation. The positioning post 34 of the pivotal shaft 31 is engaged with the pivotal trough 24 of the pivotal hole 21 on the sliding base 2. By this arrangement, when the accommodating tray 3 rotates, the engagement between the positioning post 34 of the pivotal shaft 31 and the pivotal trough 24 of the pivotal hole 21 makes the accommodating tray 3 to merely rotate to a certain angle at most, thereby helping the user to take out the tool head portions 4. The pivotal shaft 31 is provided with a symmetrical groove 33. When the pivotal shaft 31 is subjected to a pressing force when rotating, the positioning post 34 can be removed from the pivotal trough 24 of the pivotal hole 21. The accommodating tray 3 is provided with a plurality of accommodating troughs 35 for accommodating the tool head portions 4 respectively.

According to the above, the present invention has the following advantageous features.

(I) The tool storage box of the present invention can slide open and the accommodating tray can be positioned in an open location or a closed location. When a user presses the button to open the box body, the accommodating tray in the accommodating space will slide outwardly to be positioned in a proper location. Both of the sliding and positioning actions can be completed at the same time, so that the tool head portions can be taken in and out of the accommodating tray of the box body easily.

(II) The box tool of the present invention can be designed variously based on practical demands. The user can rotate the accommodating tray to different angles, so that it is easy to take the tool and the tool head portions out of the tool storage box. Further, the tool head portions are oriented to face upwards, so that the user can take the tool head portions in or out of the tool storage box quickly.

What is claimed is:

1. A tool storage box with sliding and rotating functions, including a box body, a sliding base, and an accommodating tray for accommodating various tool head portions;

wherein at least one accommodating space is provided in the box body, the accommodating space is configured to accommodate the sliding base and the accommodating tray, the accommodating space is provided with a button hole and at least one locking trough, the sliding base is provided with at least one pivotal hole and a locking hook for controlling the sliding base, the pivotal hole is provided with at least one pivotal trough, a peripheral surface of the pivotal trough is provided with a positioning surface, the sliding base is configured to control the accommodating tray to slide in the accommodating space, the accommodating tray is provided with at least one pivotal shaft and a positioning post for controlling the rotation of the accommodating tray, the pivotal shaft is engaged with the pivotal hole of the sliding base to act as a center of rotation of the accommodating tray;

whereby when the accommodating tray slides out of the box body, the positioning post is engaged with the pivotal trough, the accommodating tray is rotatable by means of an external force.

2. The tool storage box with sliding and rotating functions according to claim 1, wherein the locking hook abuts against the locking trough for positioning due to the sliding of the sliding base.

3. The tool storage box with sliding and rotating functions according to claim 2, wherein both sides of the locking hook are provided with an insertion trough respectively, so that the locking hook can act as an elastic body.

4. The tool storage box with sliding and rotating functions according to claim 1, wherein an end surface of the pivotal shaft is provided with an engaging piece, the pivotal shaft is provided with at least one groove for allowing the pivotal shaft to generate an elastic deformation, the engaging piece abuts against the positioning surface.

* * * * *